US006202514B1

(12) United States Patent
Kirk

(10) Patent No.: US 6,202,514 B1
(45) Date of Patent: Mar. 20, 2001

(54) MULTI-NUT CATCHER WRENCH

(76) Inventor: Norbert A. Kirk, 307 W. Wood Dr., Phoenix, AZ (US) 85029

( * ) Notice: Subject to any disclaimer, the term of this patent is extended or adjusted under 35 U.S.C. 154(b) by 0 days.

(21) Appl. No.: 09/372,363

(22) Filed: Aug. 11, 1999

Related U.S. Application Data

(60) Provisional application No. 60/111,595, filed on Nov. 9, 1998.

(51) Int. Cl.[7] ..... B25B 13/00
(52) U.S. Cl. ..... 81/124.4; 81/3.4
(58) Field of Search ..... 81/121.1, 124.4, 81/186, 3.4

(56) References Cited

U.S. PATENT DOCUMENTS 5,259,281 * 11/1993 Burke ..... 81/437
5,271,299 * 12/1993 Wadsworth ..... 81/121.1
5,440,957 * 8/1995 Rogers ..... 81/124.4

* cited by examiner

*Primary Examiner*—Timothy V. Eley
*Assistant Examiner*—Dung Van Nguyen
(74) *Attorney, Agent, or Firm*—Larry L. Saret; William A. Meunier; Laff, Whitesel & Saret, Ltd.

(57) ABSTRACT

The present invention provides a device for applying torque to rotatable mechanical fasteners having variously sized outer circumferences, the device comprising a flat wrench plate with a central opening therein. The central opening includes notches of various sizes, and each notch is sized and shaped to fit around and engage a different sized nut or bolt. Between each pair of adjacent notches is a protrusion directed towards the center of the central opening. The flat wrench plate is mounted within and at one end of a short, hollow handle. Preferably, the wrench plate is generally circular and the hollow handle is a cylinder sized to fit easily within a user's hand so that the user can easily grip and rotate the handle. In one embodiment, a clear cover plate having an aperture therein is mounted within the cylindrical handle at the end opposite the wrench plate. In a different embodiment, another wrench plate with different sized notches is mounted in the handle opposite the first wrench plate.

7 Claims, 4 Drawing Sheets

MULTI-NUT CATCHER WRENCH

This is a formal application that replaces Provisional Application Ser. No. 60/111,595, filed Nov. 9, 1998.

FIELD OF THE INVENTION

This invention relates generally to torque-applying tools and, more particularly, to a wrench that is especially useful in tightening or loosening a nut on a bolt.

BACKGROUND OF THE INVENTION

Wrenches secure or loosen and remove a nut from a bolt by applying torque to the nut or the head of the bolt. Conventional wrenches comprise a wrench head and an elongated wrench handle extending therefrom. With such conventional wrenches, the required torque is generated by engaging the nut or bolt within the wrench head and then applying force to the distal end of the elongated wrench handle to rotate it about the nut or bolt, thereby causing the wrench head—and the nut or bolt engaged therein—to rotate in the direction of the handle's rotation. Clockwise rotation traditionally tightens the nut and counter-clockwise motion loosened the nut. As the length of the wrench handle is increased, the user can generate more torque while reducing the amount of force applied to the distal end of the handle.

There are significant shortcomings to conventional wrenches in certain situations or environments. First, because of the length of a conventional wrench handle, conventional wrenches often cannot be used on nuts and bolts located in tight spaces. And, even if the nut or bolt can be accessed by a conventional wrench, space limitations may prevent the user from rotating the wrench handle a full rotation. In this situation, the user must disengage the wrench head, reposition the wrench and reengage the nut, and rotate the wrench handle in the appropriate direction. These time-consuming and inconvenient steps need to be repeated until the nut is completely tightened or removed from the bolt.

Another shortcoming of conventional wrenches is that they typically do not fit nuts and bolts of various sizes. Accordingly, where variously sized nuts and bolts are present or a user is not sure what size wrench a given nut or bolt requires, the user must purchase and keep handy multiple wrenches of various sizes. Or, if the wrench head is adjustable or replaceable, the user must repeatedly adjust or replace the head to finish the task at hand.

Yet another shortcoming of conventional wrenches is that they offer no way to quickly remove a nut from a bolt once the nut has been initially loosened on the bolt. With a conventional wrench, a user must continue to turn the loosened nut by (1) engaging it with the wrench head, rotating the handle and, in tight locations, disengaging and re-engaging the wrench head over the nut to rotate it again—a time-consuming and inefficient process—or (2) by disengaging the loosened nut from the wrench handle and manually turning the nut with one's fingers—an even more time-consuming and inefficient process that has the additional disadvantage of increasing the likelihood of injury to a user's knuckles and fingers.

Also, with conventional wrenches, the risk of loosing a nut is high because the wrench does not prevent a nut from falling after the nut is completely loosened from a bolt. This problem is especially prevalent when one is working on nuts and bolts that are located above an open work area, such as while working on the under side of a car.

SUMMARY OF THE INVENTION

In general, the present invention solves the foregoing shortcomings of conventional wrenches by providing a tool comprising a flat wrench plate with a central opening therein. The central opening includes notches of various sizes, and each notch is sized and shaped to fit around and engage a different sized nut or bolt. Between each pair of adjacent notches is a protrusion or tooth directed towards the center of the central opening.

The flat wrench plate is mounted within and at one end of a short, hollow handle. Preferably, the wrench plate is generally circular and the hollow handle is a cylinder sized to fit easily within a user's hand so that the user can easily grip and rotate the handle. In one embodiment, a clear cover plate having an aperture therein is mounted within the cylindrical handle at the end opposite the wrench plate. In a different embodiment, a second wrench plate with different sized notches from those of the first wrench plate is mounted in the handle opposite the first wrench plate.

To use the present invention to loosen and remove a nut from a bolt, the cylindrical handle is placed over the nut so that it is encompassed by the central opening in the wrench plate. The appropriately sized notch is then slid towards the nut so that the notch fits around and engages the nut. If a clear cover plate is mounted opposite the wrench plate, the user can look through the clear cover plate to more easily engage the nut with the appropriate notch. If an opaque cover plate or second wrench plate is mounted within the handle, then the user can look through the aperture in the cover plate or the central opening in the second wrench plate to properly engage the nut.

When the nut is engaged within the appropriate notch, the handle is then rotated in a counter-clockwise motion about the notch, thereby rotating the notch and the nut engaged therein. If desired, the user can continue to loosen the nut by rotating the handle in this manner until the nut falls free from the bolt. However, the nut can be removed much faster if, once the nut has been suitably loosened (but the nut is still on the bolt), the notch is then slid away from the nut so that the nut is once again encompassed by the central opening in the wrench plate. The handle is then rapidly spun about the nut so that the protrusions individually and successively contact and exert force on the circumference of the nut, thereby rotating and loosening the nut until it falls free from the bolt. If a plurality of nuts are closely located, this method can also be used to simultaneously remove those loosened nuts: once the nuts are loosened sequentially, they may be, depending on their location, simultaneously encompassed within the central opening and simultaneously removed by spinning the wrench handle thereabout.

Instead of falling to the ground at this point, the nut (or nuts) will be captured within the handle by the cover plate (or the second wrench plate). The nut can then be removed from the handle by dropping the nut through the aperture in the cover plate (or the central opening in the second cover plate) and into the user's hand.

To tighten a nut to a bolt, the above-described process is reversed.

DETAILED DESCRIPTION OF THE INVENTION

Figure 1:
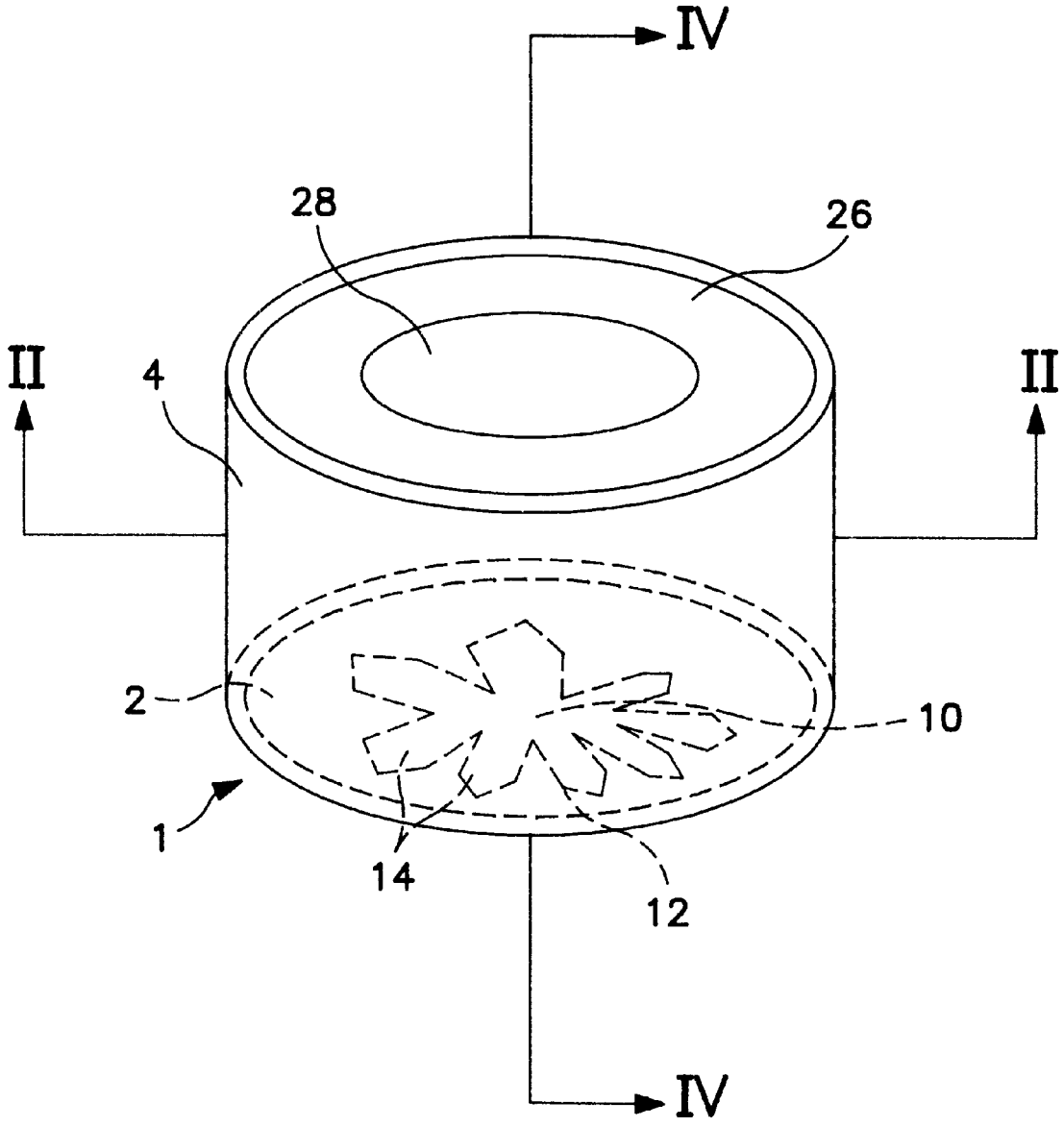
FIG. 1 is a perspective view of a first embodiment of the inventive wrench, with phantom lines showing the position of the wrench plate and the central opening therein.

As shown in FIGS. 1–5, the first embodiment of the present invention is a wrench 1 comprising a generally flat wrench plate 2 mounted within hollow handle 4. Preferably, wrench plate 2 is constructed of metal and handle 4 is made from a durable plastic material, such as polyvinyl chloride. Preferably, handle 4 has a diameter to fit easily within a user's hand so that the user can easily grip and rotate the handle. One appropriate diameter is 3.5 inches.

Wrench plate 2 is generally circular and hollow handle 4 is cylindrical. These shapes are shown for illustrative purposes only, however, and are not meant to limit the scope of the invention in any way. It is to be understood that the plate and handle can be any of a wide variety of shapes—for example, wrench plate 2 and the cross-section of handle 4 could be generally hexagonally shaped rather than circularly shaped.

The outer edge 6 of wrench plate 2 has a flat edge portion 8. Flat edge portion 8 allows wrench plate 4 to expand or contract within handle 4 in response to temperature changes. It also decreases the possibility of wrench plate 2 rotating within handle 4.

Wrench plate 2 has a central opening 10. Central opening 10 includes a plurality of notches 14 defined by edge 12 of wrench plate 2. Each notch 14 is sized and shaped to engage the circumference of a different sized rotatable fastener, such as a nut or bolt. For example, if the invention is meant to be used with various sizes of hexagonal nuts 15, then notches 14 are sized and shaped to engage different sized hexagons. Each notch 14 has side walls 16 and 18 and back walls 20 and 22. Back walls 20 and 22 meet to form about a 60 degree angle, while each side wall forms about a 60 degree angle with its adjacent back wall, i.e., side wall 16 forms about a 60 degree angle with back wall 20, while side wall 18 forms about a 60 degree angle with back wall 22.

Figure 7:
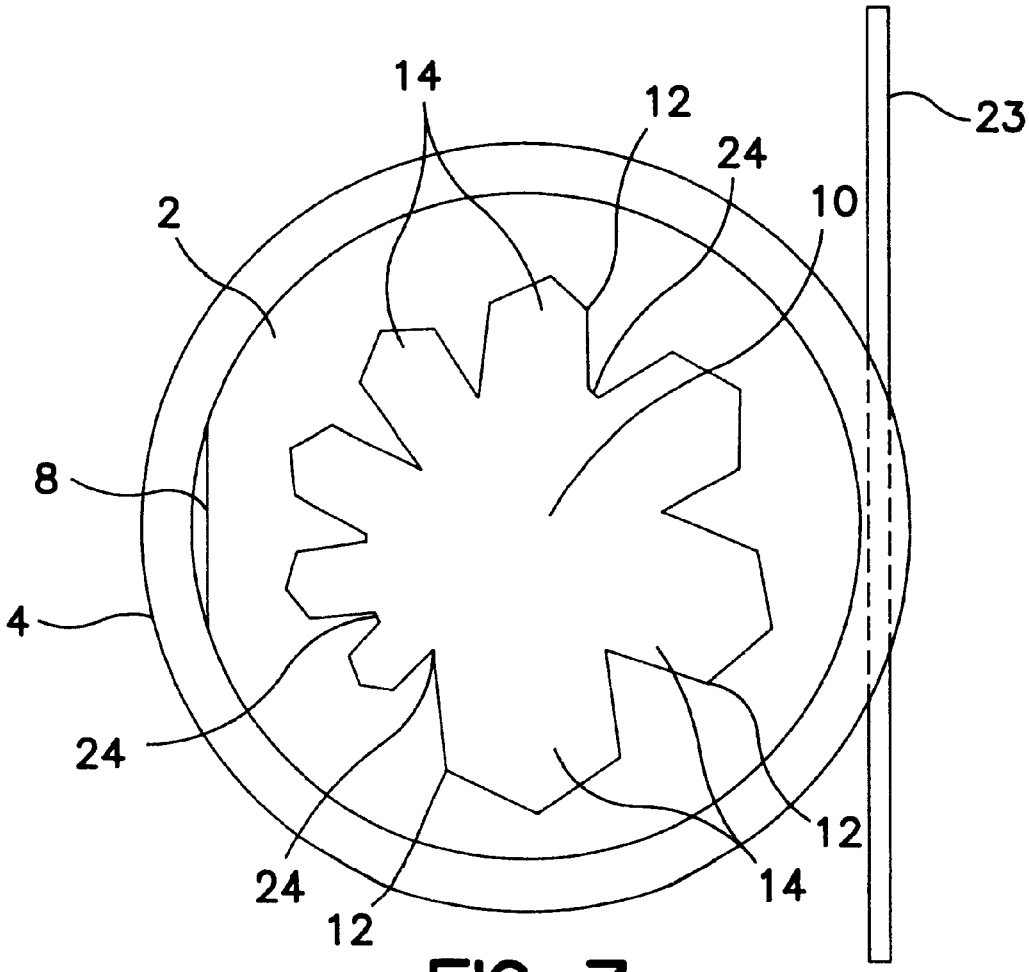
FIG. 7 is a bottom view of the embodiment of FIG. 1 with a lever bar attached thereto.

The number of notches 14 that can be featured in wrench plate 2 is dictated by the diameter of wrench plate 2—the larger the diameter, the greater the number of notches that can be placed in wrench plate 4. Where work space is limited, it is preferable that the diameter of the wrench plate 2 be smaller and, therefore, the number of notches fewer. On the other hand, where wrench 1 is to be used with a large number of different sized fasteners and space is not an issue, the diameter of the wrench plate 2 and the number of notches 14 may be greater. If the diameter of wrench plate 14 is so large that handle 4 does not fit comfortably within the user's hand, it may be necessary to attach a bar 23 tangentially to handle 4 to provide better lever for rotating wrench 1, as shown in FIG. 7.

Notches 14 are separated by a plurality of protrusions 24 defined by inner edge 12 of plate 2 and directed toward the center of central opening 10. As described herein, these protrusions can be used to quickly rotate a rotatable fastener located within the central opening. Protrusions 24 are formed by the intersection of the side walls of adjacent notches. For example, in FIG. 2, protrusion 24*a* is formed by the intersection of side wall 18 of notch 14*a* and side wall 16 of notch 14*b*.

Figure 4:
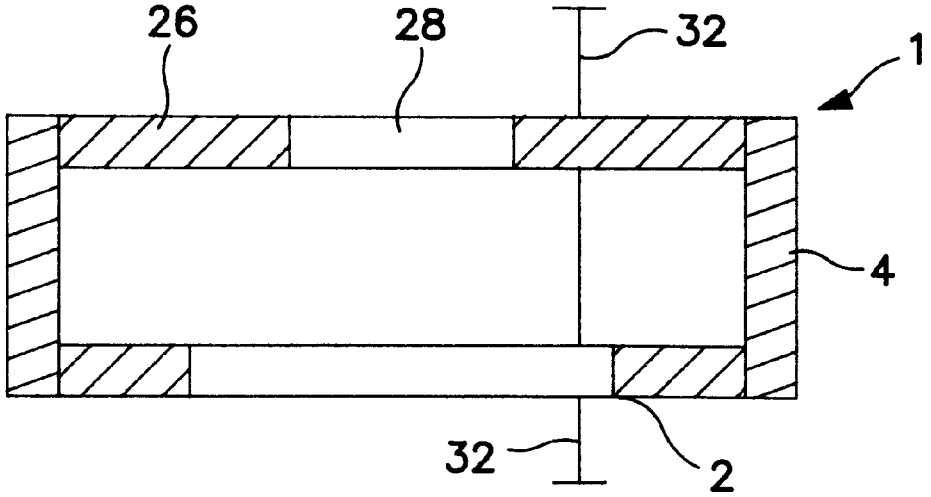
FIG. 4 is a cross-sectional side view of the embodiment of FIG. 1 taken along line IV—IV.
Figure 5:
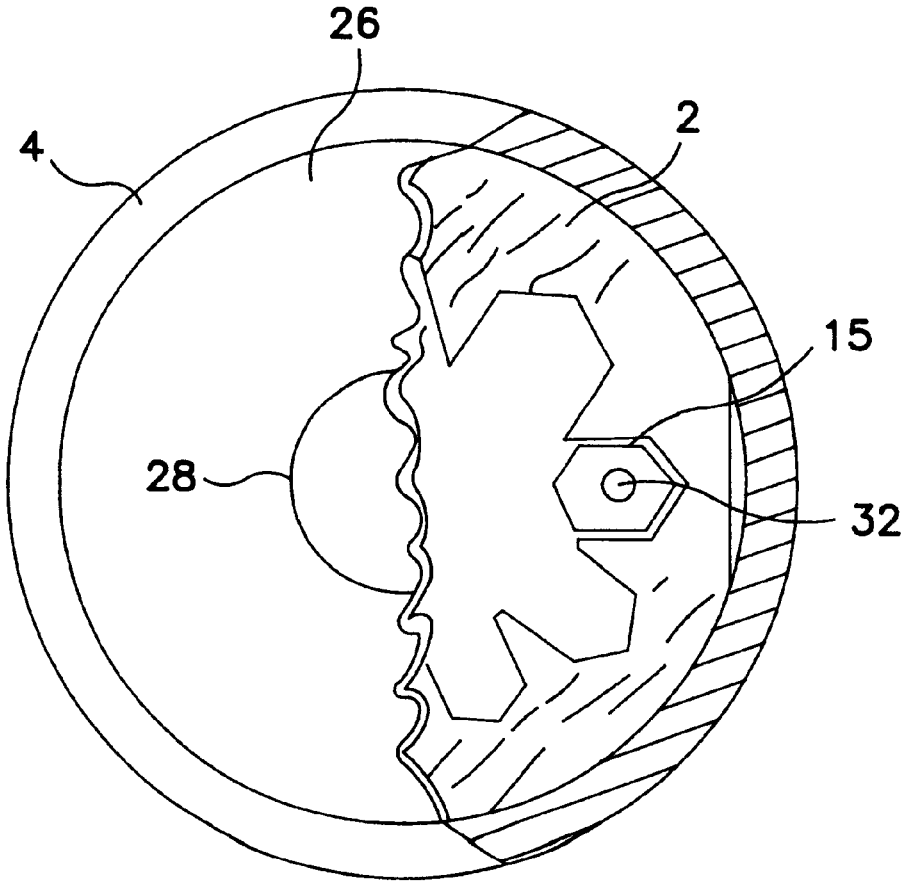
FIG. 5 is a partially cut away top view of the embodiment of FIG. 1 and a nut within the central opening thereof, but not engaged by any notches.

As shown in FIGS. 4 and 5, this embodiment of the invention further comprises a cover plate 26 to catch a fastener as it is removed using the inventive tool. Preferably, cover plate 26 is constructed from a transparent plastic material so that a user can observe a fastener through the cover plate. As seen in FIG. 4, plate 2 and cover plate 26 are mounted within opposite ends of handle 4. Cover plate 26 defines aperture 28, through which a loosened fastener can be removed from handle 4 after it has been removed from a bolt and initially captured by the wrench.

Figure 2:
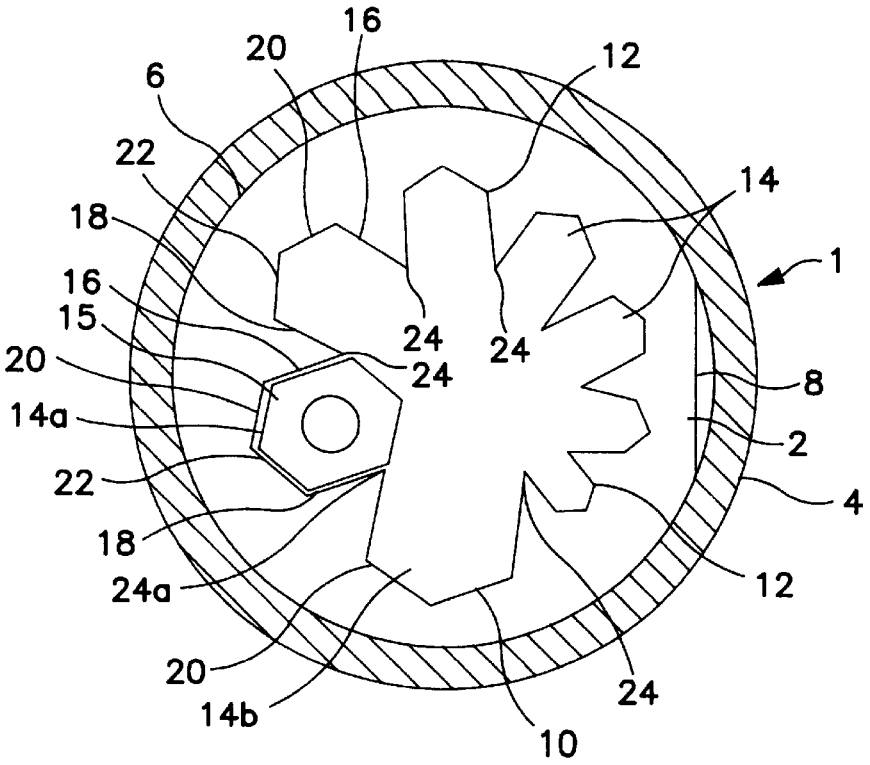
FIG. 2 is a cross-sectional top view of the embodiment of FIG. 1 taken along line II—II and a nut engaged within a notch thereof.
Figure 3:
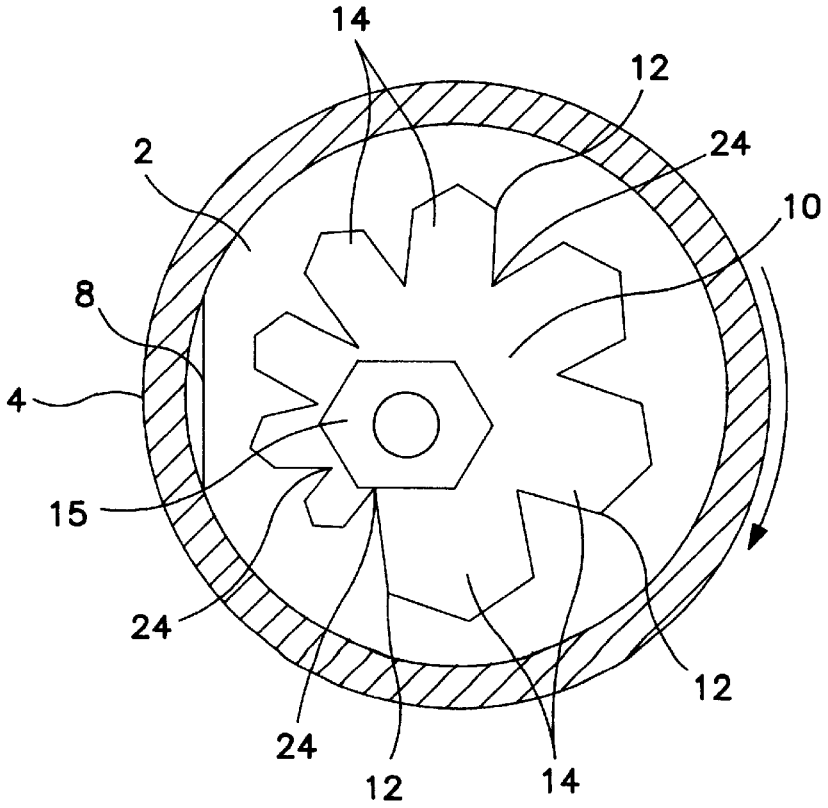
FIG. 3 is a cross-sectional top view of the embodiment of FIG. 1 taken along line II—II and a nut within the central opening thereof, but not engaged by any notches.

The inventive wrench 1 described herein can be used to apply torque—and thereby loosen or tighten—any number of rotatable fasteners. For example, wrench 1 can be used to loosen and remove a hexagonal nut 15 from a bolt. As seen in FIG. 3, handle 4 is placed over nut 15 so that it is encompassed by central opening 10 in wrench plate 2. The appropriately sized notch 14*a* is then slid towards nut 15 so that notch 14*a* fits around and engages the nut, as shown in FIGS. 2 and 5. Nut 15 can be seen through clear cover plate 26, thereby allowing the user to more easily engage nut 15 with the appropriate notch.

Once nut 15 is engaged within notch 14*a*, handle 4 and wrench plate 2 are then rotated in a counter-clockwise motion about rotational axis 32 of nut 15, thereby rotating notch 14*a* and nut 15. As seen in FIGS. 4 and 5, rotational axis 32 extends through and is surrounded by both wrench plate 2 and handle 4. It should be understood that the location of the rotational axis about which wrench 1 is rotated will change depending upon which notch is used to engage the nut to which torque is being applied.

Once the rotation of handle 4 and wrench plate 2 has suitably loosened nut 15 (but the nut is still on the bolt), notch 14*a* is slid away from nut 15 so that nut 15 is not engaged within a single notch, as shown in FIG. 3. Handle 4 is then rapidly rotated so that protrusions 24 individually and successively contact and exert force on the circumference of nut 15 (see FIG. 3), thereby rotating and loosening nut 15 until it falls free from the bolt. Thus, unlike a conventional wrench where the nut is continuously gripped while being turned, the present invention can be used to loosen a nut by successively impacting upon the circumference of the nut 15. This motion takes advantage of the speed at which the inventive wrench can be rotated when it is not continuously opposed by the nut.

Nut 15 is then captured within handle 4 by cover plate 26. Nut 15 can then be removed from handle 4 by dropping nut 15 through aperture 28 in cover plate 26 and into the user's hand, or other nuts can be loosened before emptying them from the wrench.

Figure 6:
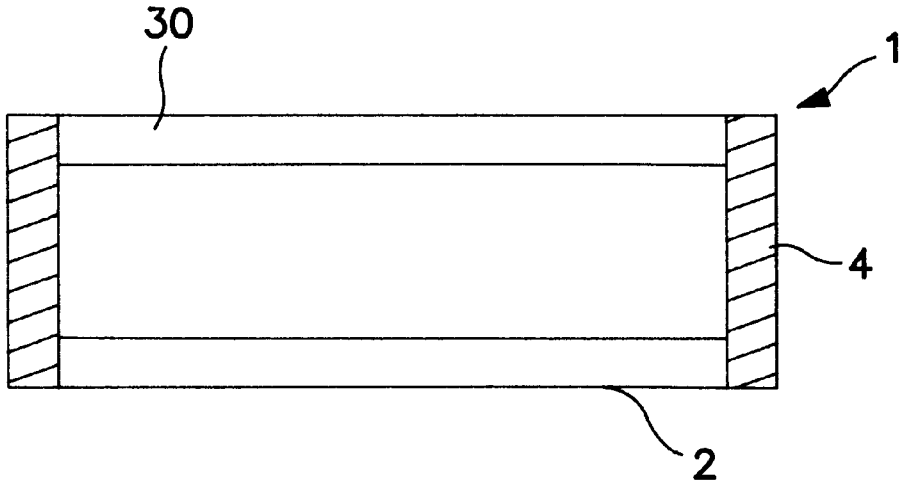
FIG. 6 is a cross-sectional side view of a second embodiment of the inventive wrench.

As seen in FIG. 6, a third embodiment of the present invention features a second wrench plate 30, rather than a cover plate. This arrangement allows twice as many different sized notches 14 to be included in the inventive tool without increasing the diameter of handle 4. For example, one wrench plate may feature notches sized and shaped to fit S.A.E. sized nuts, while the other wrench plate features notches for metric sized nuts. Alternatively, the number of notches on each of the two wrench plates can be reduced, thereby allowing the diameter of the handle to be decreased so that the invention can be used in even tighter spaces. The third embodiment is used generally in the same manner as the embodiments described above.

While the present invention is described above in connection with specific embodiments, the invention is intended to cover all alternatives, modifications or equivalents that may be included within its sphere and scope, as defined by the appended claims.

What is claimed is:

1. A device for applying torque to a rotatable mechanical fastener having an outer circumference, the device comprising:

a first wrench plate having outer and inner edges, the inner edge defining a central opening within the first wrench plate;

the central opening including at least one notch defined by the inner edge, the at least one notch being sized and shaped to engage the outer circumference of the fastener; and a handle having an inner circumference surrounding and engaging the first wrench plate's outer edge; and a cover plate mounted within the handle opposite the first wrench plate, wherein the cover plate has an aperture and is transparent, and whereby torque can be applied to the fastener by engaging the fastener with the at least one notch and rotating the first wrench plate.

2. A device for applying torque to a rotatable mechanical fastener having an outer circumference, the device comprising:

a first wrench plate having outer and inner edges, the inner edge defining a central opening within the first wrench plate, wherein the outer edge of the first wrench plate includes a flat edge portion;

the central opening including at least one notch defined by the inner edge, the at least one notch being sized and shaped to engage the outer circumference of the fastener; and a handle having an inner circumference surrounding and engaging the first wrench plate's outer edge;

whereby torque can be applied to the fastener by engaging the fastener with the at least one notch and rotating the first wrench plate.

3. A device for applying torque to a rotatable mechanical fastener having an outer circumference, the device comprising:

a first wrench plate having outer and inner edges the inner edge defining a central opening within the first wrench plate;

the central opening including at least one notch defined by the inner edge, the at least one notch being sized and shaped to engage the outer circumference of the fastener;

a handle having an inner circumference surrounding and engaging the first wrench plate's outer edge; and a lever bar secured to the handle, whereby torque can be applied to the fastener by engaging the fastener with the at least one notch and rotating the first wrench plate.

4. A device for applying torque to a rotatable mechanical fastener having an outer circumference, the device comprising:

a first wrench plate having outer and inner edges, the inner edge defining a central opening within the first wrench plate;

the central opening including at least one notch defined by the inner edge, the at least one notch being sized and shaped to engage the outer circumference of the fastener;

a handle having an inner circumference surrounding and engaging the first wrench plate's outer edge; and a second wrench plate mounted within the handle opposite the first wrench plate, the second wrench plate having an inner edge defining a central opening, the central opening of the second wrench plate including at least one notch defined by the second wrench plate's inner edge, and the at least one notch of the second wrench plate being sized and shaped to engage a rotatable mechanical fastener, whereby torque can be applied to the fastener by engaging the fastener with the at least one notch and rotating the first wrench plate.

5. A device for applying torque to a rotatable mechanical fastener having a rotational axis, the device comprising:

a cylindrical handle having two opposing ends;

a first wrench plate mounted within the handle at one of said opposing ends, the wrench plate having a central opening dimensioned to engage the rotatable mechanical fastener; and a second wrench plate mounted within the handle opposite the first plate, the second wrench plate having a central opening dimensioned to engage the rotatable mechanical fastener, whereby the rotational axis of the mechanical fastener extends through the handle and the second wrench plate when the mechanical fastener is engaged by the central opening, whereby the rotational axis of the mechanical fastener extends through the handle and the first wrench plate when the mechanical fastener is engaged by the central opening.

6. A device for applying torque to a rotatable mechanical fastener having an outer circumference, the device comprising:

a handle;

a first wrench plate having an inner edge defining a central opening and engaged and surrounded by the handle;

a plurality of protrusions defined by the inner edge and directed into the central opening; and a cover plate mounted within the handle and spaced apart from the first wrench plate, wherein the cover plate is transparent, and whereby torque can be applied to the fastener by placing the fastener within the central opening and rotating the first wrench plate about the fastener so that the protrusions individually and successively contact and exert force on the circumference of the fastener.

7. A device for applying torque to a rotatable mechanical fastener having an outer circumference, the device comprising:

a handle;

a first wrench plate having an inner edge defining a central opening and engaged and surrounded by the handle;

a plurality of protrusions defined by the inner edge and directed into the central opening; and a second wrench plate mounted within the handle and spaced apart from the first wrench plate, the second wrench plate having an inner edge defining a central opening;

the central opening including a first notch defined by the second wrench plate's inner edge, the second wrench plate's first notch being sized and shaped to engage a rotatable mechanical fastener, whereby torque can be applied to the fastener by placing the fastener within the central opening and rotating the first wrench plate about the fastener so that the protrusions individually and successively contact and exert force on the circumference of the fastener.

* * * * *